US011486085B2

(12) United States Patent
Erickson

(10) Patent No.: US 11,486,085 B2
(45) Date of Patent: Nov. 1, 2022

(54) APPARATUS FOR SECURING ITEMS TO A DRUM OF A WASHER AND DRYER

(71) Applicant: Barry G. Erickson, Hurricane, UT (US)

(72) Inventor: Barry G. Erickson, Hurricane, UT (US)

( * ) Notice: Subject to any disclaimer, the term of this patent is extended or adjusted under 35 U.S.C. 154(b) by 93 days.

(21) Appl. No.: 17/088,361

(22) Filed: Nov. 3, 2020

(65) Prior Publication Data

US 2022/0136167 A1 May 5, 2022

(51) Int. Cl.

| | |
|---|---|
| ***D06F 95/00*** | (2006.01) |
| ***D06F 58/20*** | (2006.01) |
| ***D06F 37/02*** | (2006.01) |
| ***D06F 37/08*** | (2006.01) |
| ***D06F 37/16*** | (2006.01) |

(52) U.S. Cl.

CPC ..... *D06F 95/008* (2013.01); *D06F 37/02* (2013.01); *D06F 37/08* (2013.01); *D06F 58/20* (2013.01); *D06F 37/16* (2013.01)

(58) Field of Classification Search

CPC ..... D06F 95/008; D06F 37/02; D06F 58/20; D06F 37/08; D06F 37/12

USPC ..... 34/600, 192, 194, 237, 238, 239; 312/228.1

See application file for complete search history.

(56) References Cited

U.S. PATENT DOCUMENTS 1,563,552 A * 12/1925 Butzbach ..... D06F 37/08 68/143
1,862,652 A * 6/1932 Balzer ..... D06F 37/08 68/143
1,959,546 A * 5/1934 Power ..... D06F 37/08 68/210
2,191,891 A * 2/1940 Levitetz ..... D06F 37/08 68/210
2,281,031 A * 4/1942 Francey ..... D06F 37/08 68/210
3,316,659 A * 5/1967 Lauck ..... D06F 58/04 34/109
4,109,397 A * 8/1978 Daily ..... D06F 58/04 34/239
4,691,400 A * 9/1987 Arneson ..... A47L 21/02 15/210.1
4,702,016 A * 10/1987 Grigsby ..... D06F 58/04 34/106
5,220,734 A * 6/1993 Carver ..... D06F 58/04 34/104
5,365,675 A * 11/1994 Shabram, Jr. ..... D06F 58/04 34/239

(Continued)

FOREIGN PATENT DOCUMENTS

WO WO-9500718 A1 * 1/1995 ..... A47L 17/02

*Primary Examiner* — Hanh V Tran

(74) *Attorney, Agent, or Firm* — Gurr Brande & Spendlove, PLLC; Robert A. Gurr

(57) ABSTRACT

An apparatus for securing items to the drum of a washer or dryer includes a plate with a first finger lift and a second finger lift, strap apertures, cutout portions, coupling apertures, and a drum coupler. The first and second finger lifts may protrude from the plate, allowing a user to pull on and detach the plate from the drum. The strap apertures may receive straps therein so as to couple an item, such as a shoe, knee pads, cap, etc., to the plate. Further, the coupling apertures may comprise protrusions to receive a bracket, which may be pivotally coupled to the coupling apertures, allowing the bracket to pivot.

15 Claims, 11 Drawing Sheets

(56) References Cited

U.S. PATENT DOCUMENTS 5,623,769 A * 4/1997 Hayden ..... D06F 58/04 34/106
5,743,025 A * 4/1998 Jordan, Jr. ..... D06F 58/04 34/600
6,026,592 A * 2/2000 Herr ..... D06F 34/18 34/550
6,067,729 A * 5/2000 Willis ..... D06F 58/04 34/104
6,115,936 A * 9/2000 Arlie ..... D06F 58/04 34/106
6,374,509 B1 * 4/2002 Jackson, Sr. ..... D06F 58/04 34/106
6,732,447 B2 * 5/2004 Tomasi ..... D06F 58/04 34/106
7,313,933 B2 * 1/2008 Carey ..... D06F 39/12 68/3 R
7,552,545 B2 * 6/2009 Crawford ..... D06F 58/04 34/237
7,628,043 B2 * 12/2009 Sunshine ..... D06F 39/12 68/38
7,687,045 B2 * 3/2010 Lu ..... A61L 2/18 219/679
7,735,345 B2 * 6/2010 Wright ..... D06F 35/003 68/3 R
7,913,419 B2 * 3/2011 Tomasi ..... D06F 58/10 38/14
8,096,062 B1 * 1/2012 Bellen ..... D06F 58/10 68/5 R
8,381,552 B2 * 2/2013 Kendall ..... D06F 39/00 68/3 R
8,484,867 B2 * 7/2013 Roselle ..... D06F 58/10 38/14
8,650,773 B2 * 2/2014 Ackermann ..... D06F 58/04 34/194
8,914,991 B2 * 12/2014 Jackson ..... D06F 58/04 34/600
9,322,124 B1 * 4/2016 Al-Hasan ..... D06F 58/203
2002/0032932 A1 * 3/2002 Kim ..... D06F 37/12 68/16
2002/0092329 A1 * 7/2002 Rhode ..... D06F 95/006 68/152
2005/0126035 A1 * 6/2005 Lee ..... D06F 58/04 34/602
2006/0096120 A1 * 5/2006 Moschutz ..... D06F 58/04 34/237
2007/0056997 A1 * 3/2007 Radtke ..... D06F 95/008 223/84
2007/0151310 A1 * 7/2007 Wright ..... D06F 35/003 68/5 R
2008/0022551 A1 * 1/2008 Banta ..... D06F 58/04 34/602
2009/0300934 A1 * 12/2009 Hesse ..... D06F 58/04 34/106
2010/0132218 A1 * 6/2010 Etemad ..... D06F 58/04 34/239
2013/0180123 A1 * 7/2013 James ..... D06F 39/12 312/228.1
2014/0137426 A1 * 5/2014 Woodson ..... D06F 58/04 68/237
2017/0350062 A1 * 12/2017 Vaidhyanathan ..... D06F 58/20
2018/0187364 A1 * 7/2018 Kim ..... D06F 29/005
2018/0347103 A1 * 12/2018 Lee ..... D06F 29/005
2020/0354882 A1 * 11/2020 Bray ..... D06F 59/02

* cited by examiner

APPARATUS FOR SECURING ITEMS TO A DRUM OF A WASHER AND DRYER

CROSS-REFERENCE TO RELATED APPLICATIONS

Not applicable.

TECHNICAL FIELD

The present disclosure relates to washing and drying items in washers and dryers. More particularly, the present disclosure relates to an apparatus for securing items to the drum of a washer or dryer to increase washing efficiency and decrease damage and noise.

BACKGROUND

Footwear has been important to humankind for thousands of years. Footwear has generally been designed to protect feet from harm; however, numerous other purposes for footwear have been exhibited throughout the years, such as footwear for sports, work, fashion, etc. All types of footwear, no matter the end use, become dirty overtime. People generally do not enjoy wearing wet footwear, dirty footwear, nor footwear that contains or acquires foul odors, which often leads to the footwear being disposed of and replaced.

Apart from some footwear which cannot be effectively washed, a large variety of footwear, including tennis footwear, garden footwear, work footwear, and even children's footwear, contains materials which are washable and may be washed by users. Accordingly, there are a variety of ways to clean footwear, including washing by hand, placing in a washing machine, or using chemicals. Washing by hand is time-consuming and may not be effective. Chemical sprays or cleaners may be used also be used, but these chemicals may stain, bleach, or otherwise compromise the integrity of the footwear material and may be hazardous to a user.

Using a machine may be preferable, but loose footwear can damage portions of washing machines, damage other items in the washing machine, or the footwear can be damaged during the washing cycle. Additionally, it can be loud to allow loose footwear to agitate/tumble in a washer. Also, footwear may create an uneven balance in the washing machine creating tremendous vibrations or preventing the spin cycle due to the imbalance.

After washing footwear, many people attempt to dry the footwear outside, which may lead to long drying times, uneven drying, or unexpected smells. Fortunately, a modern drying machine can aid the user in drying their footwear evenly and quickly, but there are still complications similar to those previously presented with washing machines, such as the damage heavy footwear may cause to the drying machine, uneven tumbling, damage to the drum, damage to the footwear, etc.

Another shortcoming of washing and drying footwear comes from the noise that is created. Many washing and drying machines use a spinning drum to help enhance washing and drying. However, footwear is heavy and creates a large amount of noise when the drum spins, which may wake sleeping children and frustrate nearby neighbors.

Additionally, there may be other items that a user desires to wash and dry without tumbling, such as baseball caps or other items. While the cap may not prove noisy, the cap can become deformed when freely spinning/tumbling in a washer or dryer.

Accordingly, there is a need for an apparatus that provides a safer and more efficient way to wash and dry footwear and other items. The present disclosure seeks to solve these and other problems.

SUMMARY OF EXAMPLE EMBODIMENTS

In one embodiment, an apparatus for securing items to the drum of a washer and dryer (hereinafter referred to as "securing apparatus") comprises a plate with a first finger lift and a second finger lift, strap apertures, cutout portions, coupling apertures, and one or more magnets for coupling the plate to the drum. The plate may further comprise a water aperture to allow water to drain therefrom. The first and second finger lifts may protrude from the plate, allowing a user to pull on and detach the securing apparatus. The strap apertures may receive straps therein so as to couple an item, such as a shoe, knee pads, cap, etc., to the plate.

In one embodiment, a securing apparatus comprises an electromagnet to couple the panel to the drum of the washer and the dryer. The electromagnet may be activated and deactivated via an actuator.

In one embodiment, a securing apparatus comprises a metal plate and magnets. The magnets may be positioned inside of the item (e.g., shoes) so as to couple the item directly to the plate via magnetism. The plate may have drum magnets coupled thereto, to secure the metal plate to the drum.

DETAILED DESCRIPTION OF EXAMPLE EMBODIMENTS

Figure 1:
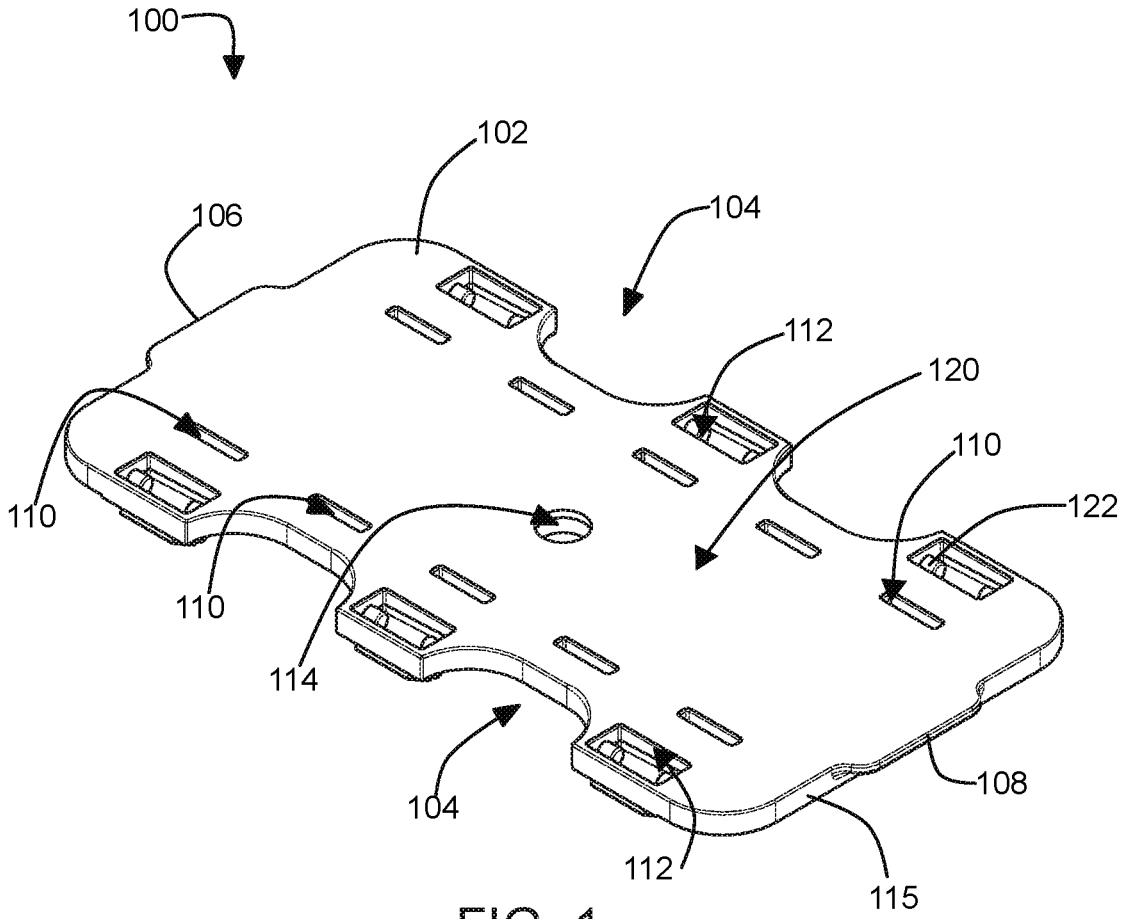
FIG. 1 illustrates a top, side perspective view of an apparatus for securing items to the drum of a washer and dryer.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for an apparatus that provides a safer and more efficient way to wash and dry footwear and other items. The present disclosure seeks to solve these and other problems.

Generally, the securing apparatus comprises a plate with drum couplers (e.g., magnets) attached thereto and straps to secure items. Once the items are secured, the securing apparatus may be placed within a drum of a washer or dryer, with the magnets securing the plate in place on the drum. Because the plate is secured to the drum, damage is prevented to the drum and mechanical parts of the washer and dryer, the footwear or other item is protected, and noise is reduced. It will also be appreciated that when the footwear is coupled to the drum, centrifugal forces aid in pushing water out of the shoes, accelerating drying time.

Figure 2:
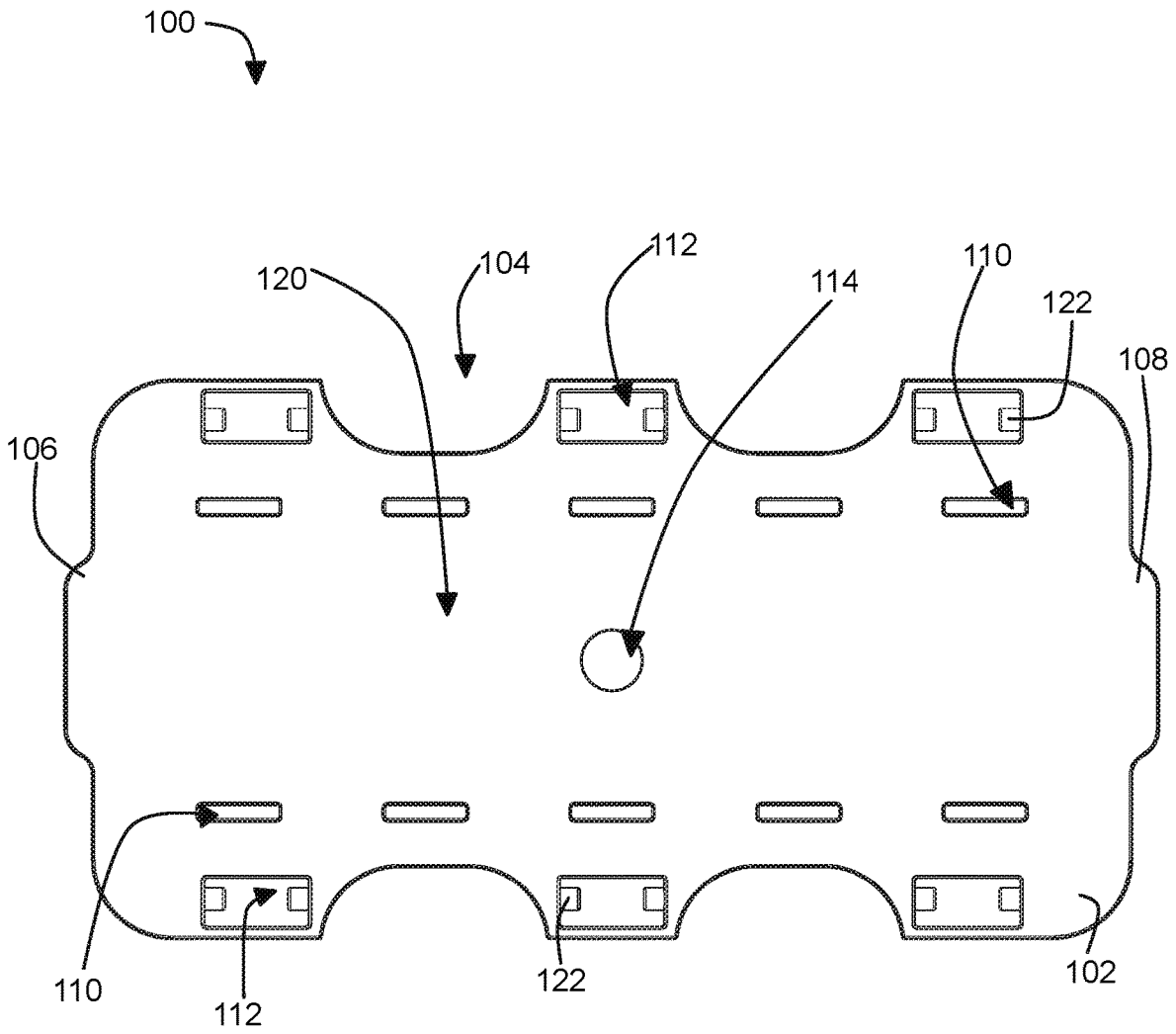
FIG. 2 illustrates a top plan view of an apparatus for securing items to the drum of a washer and dryer.

Referring to FIGS. 1-2, in one embodiment, a securing apparatus comprises a plate 102 with cutout portions 104, a first finger lift 106 and a second finger lift 108, strap apertures 110, and coupling apertures 112. The plate 102 may be manufactured of a plastic material, carbon fiber, aluminum, or any other material that can withstand repeated cycles in a washer or dryer. The plate 102 is not limited to rigid materials as those previously described. It will be appreciated that the plate 102 may be manufactured from a pliable material, such as silicone. The plate 102, as illustrated, is flat; however, in some embodiments, the plate 102 may be concave to resemble the cylindrical shape of a washer and dryer drum, thereby increasing adherence. In particular, the plate 102 may be concave along the latitudinal axis or alternatively, along the longitudinal axis. Further, the plate 102 may be rectangular, shoe-shaped, ovular, or any other shape.

The cutout portions 104 may create a lighter plate so as to decrease the effect of additional weight on the drum. Additionally, the cutout portions 104 may produce a plate with less material, thereby decreasing manufacturing costs. While the plate 102 is shown with cutout portions 104, it will be appreciated that the plate 102 may be manufactured without cutout portions 104. To allow water to pass through the plate 102 and create a lighter plate, the plate 102 may further have a water aperture 114. While one water aperture 114 is shown, it will be appreciated that numerous apertures may be present or none.

The first and second finger lifts 106, 108 (i.e., a finger protrusion) may protrude from an outer edge 115 of the plate 102, allowing a user to place a finger under one or both of the finger lifts 106, 108, pull on, and detach the securing apparatus 100 from the drums. In some embodiments, the plate 102 may comprise finger apertures or finger cables to more easily remove the securing apparatus 100 from the drum. However, in some embodiments, the plate 102 lacks finger lifts or finger apertures. Consequently, to remove the plate without finger lifts, a user would grasp the plate 102 on the outer edge 115, pulling the plate 102 away from the drums.

Figure 3:
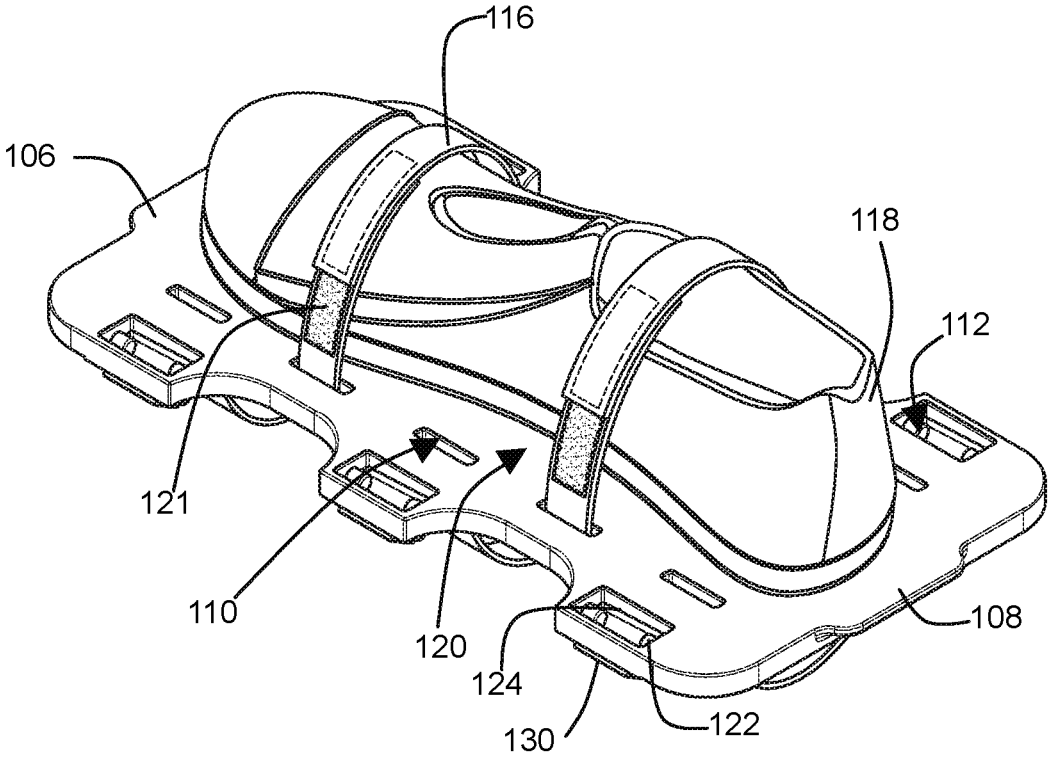
FIG. 3 illustrates a top, side perspective view of an apparatus for securing items to the drum of a washer and dryer with a shoe coupled thereto.
Figure 4:
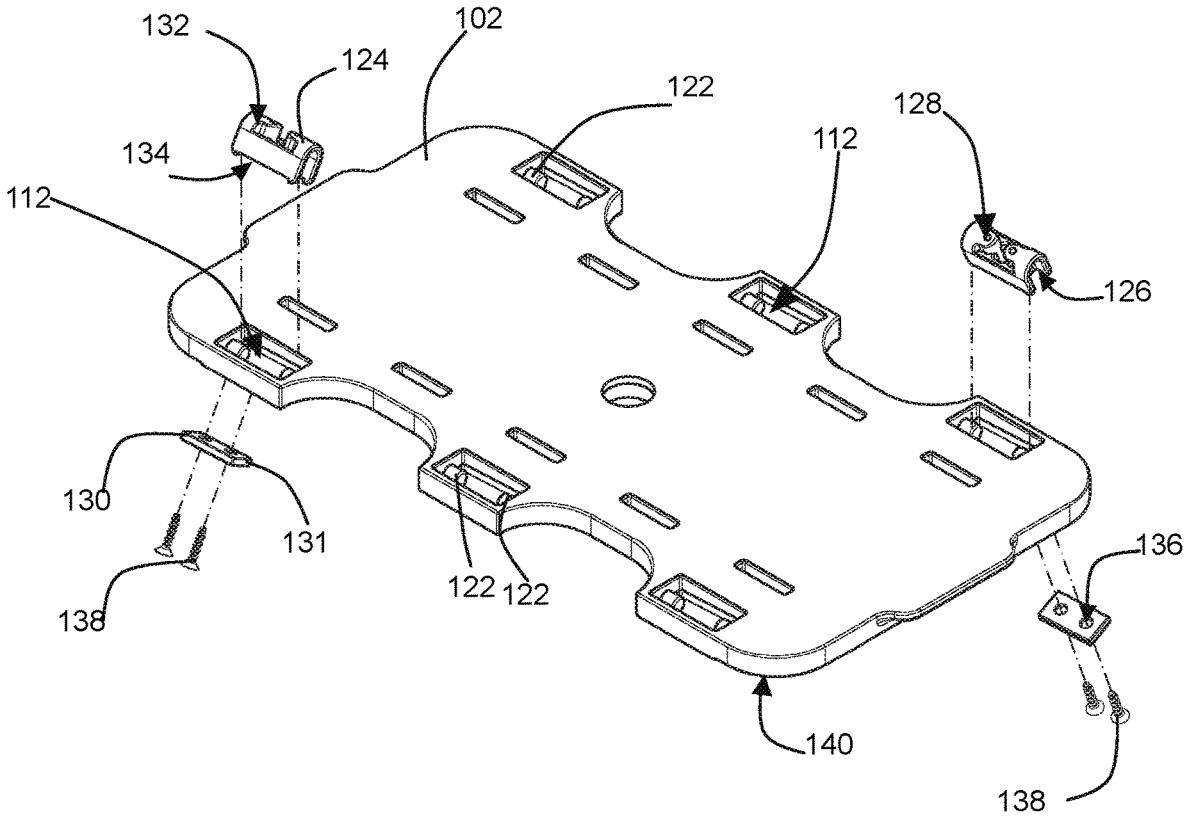
FIG. 4 illustrates a top, side perspective view of an apparatus for securing items to the drum of a washer and dryer with brackets decoupled therefrom.
Figure 5:
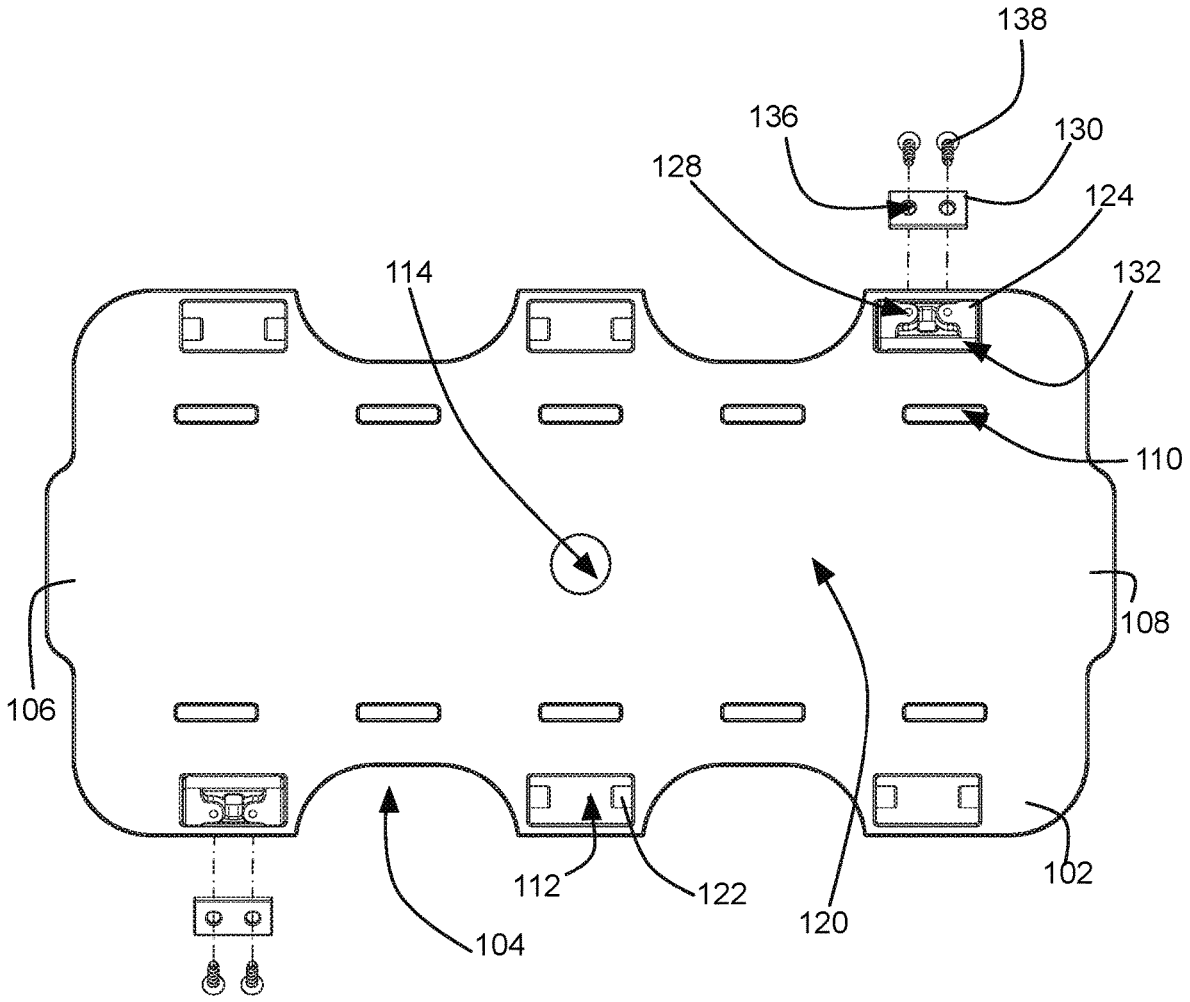
FIG. 5 illustrates a top plan view of an apparatus for securing items to the drum of a washer and dryer with brackets decoupled therefrom.
Figure 6:
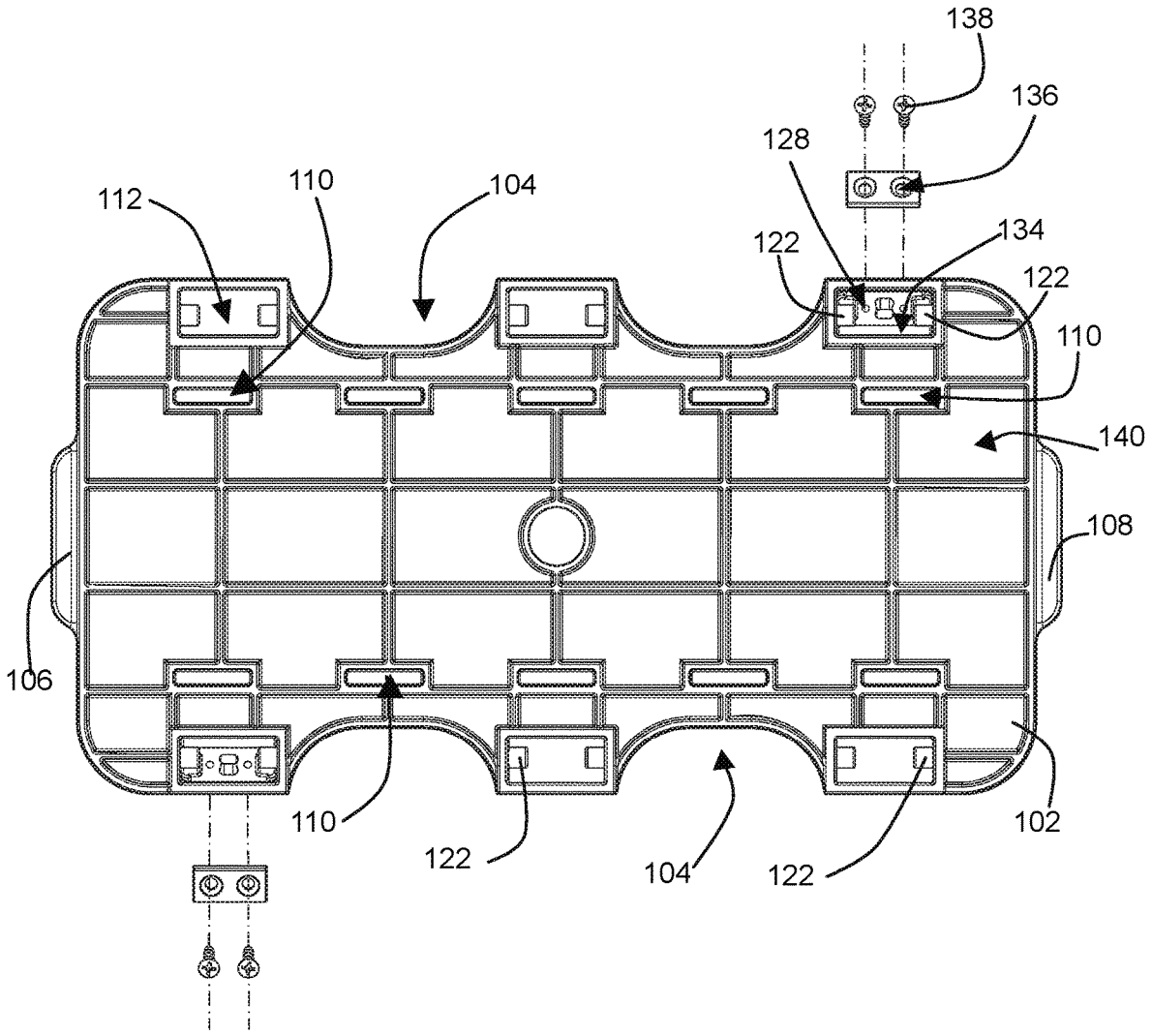
FIG. 6 illustrates a bottom plan view of an apparatus for securing items to the drum of a washer and dryer with brackets decoupled therefrom.
Figure 7:
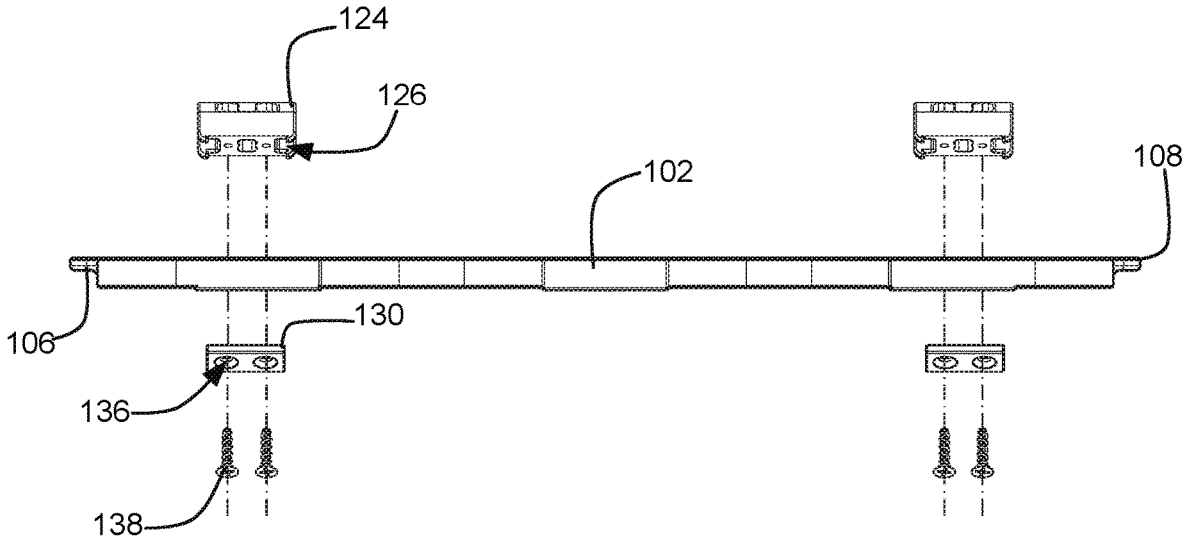
FIG. 7 illustrates a side elevation view of an apparatus for securing items to the drum of a washer and dryer with brackets decoupled therefrom.
Figure 8:
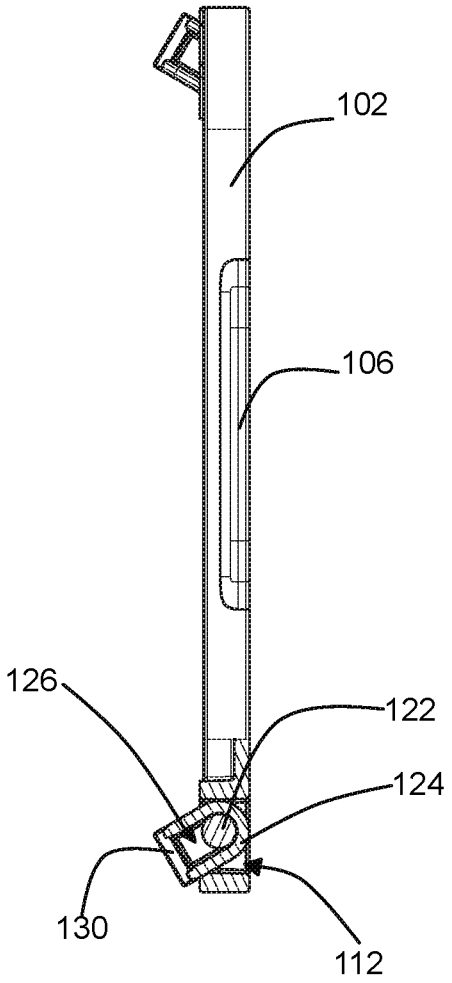
FIG. 8 illustrates a front elevation view of an apparatus for securing items to the drum of a washer and dryer with brackets extended, including a partial cutaway view.
Figure 9:
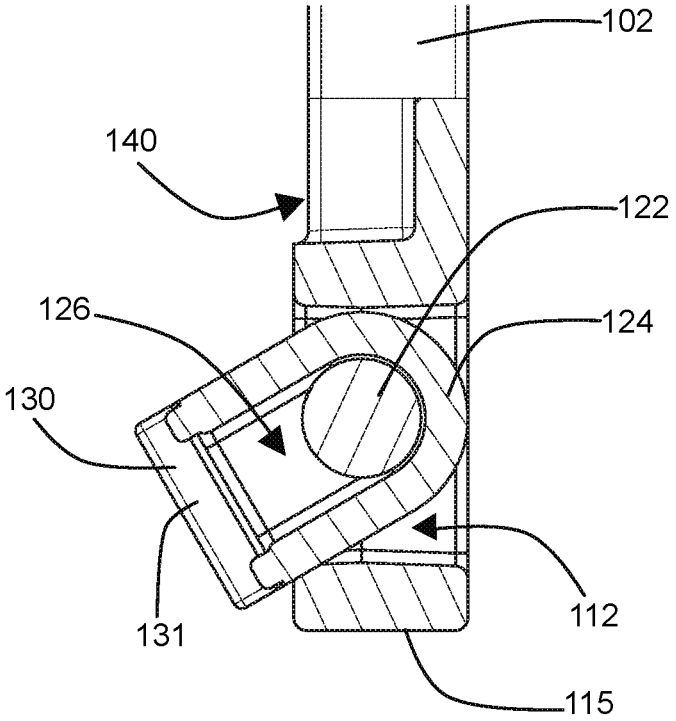
FIG. 9 illustrates a detailed sectional view of a bracket coupled to an apparatus for securing items to the drum of a washer and dryer.
Figure 10:
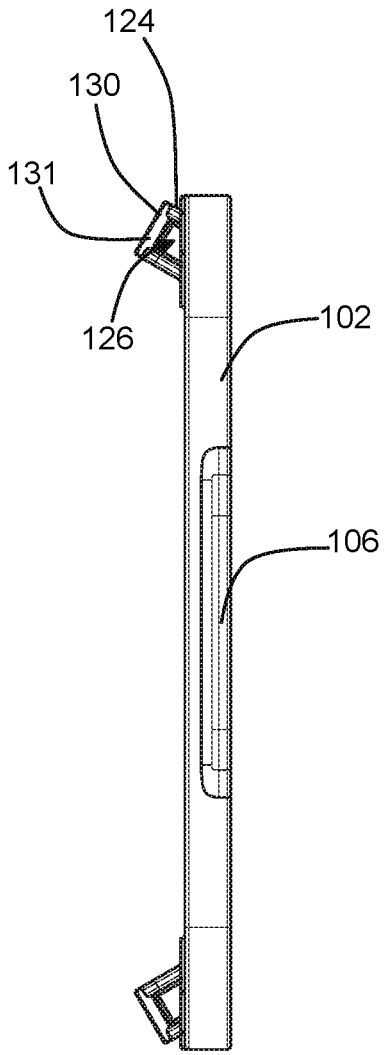
FIG. 10 illustrates a front elevation view of an apparatus for securing items to the drum of a washer and dryer with brackets extended.
Figure 11:
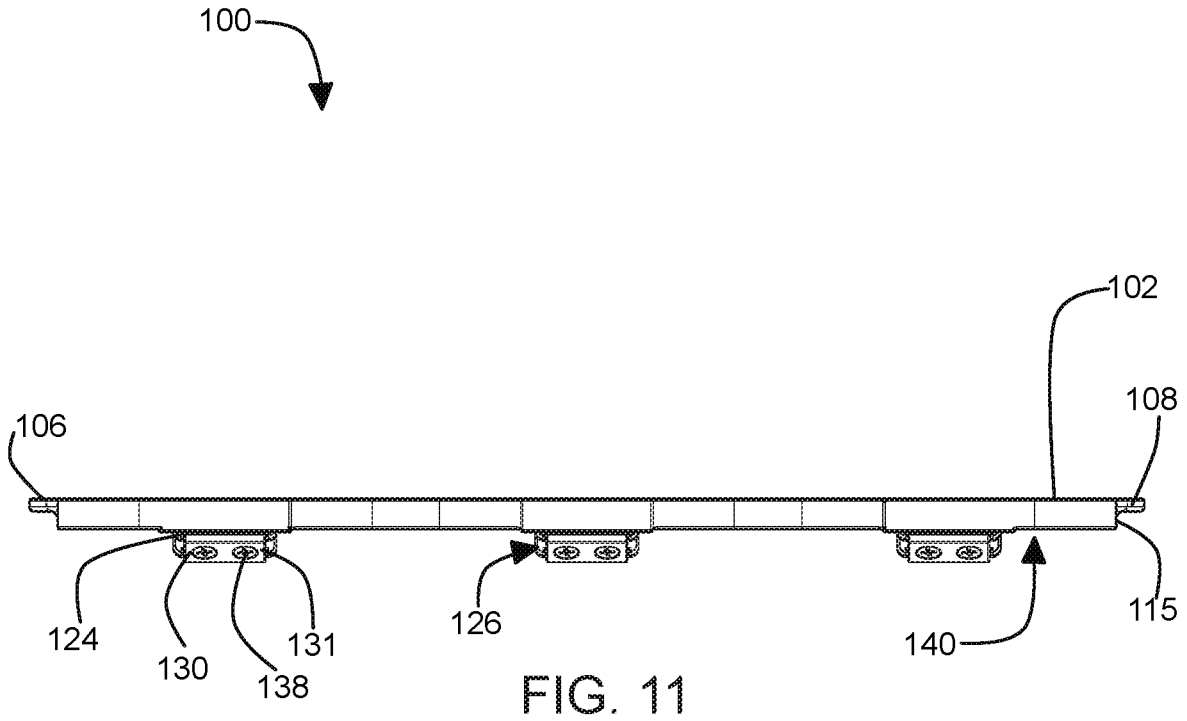
FIG. 11 illustrates a side elevation view of an apparatus for securing items to the drum of a washer and dryer with brackets extended.

As shown in FIG. 3, the strap apertures 110 may receive one or more straps 116, 117 therein so as to couple an item 118, such as a shoe, knee pads, etc., to the plate 102. In other words, straps 116, 117 may be placed in the strap apertures 110, which may be positioned parallel to one another on both sides of an item receiving area 120 and extend around the plate 102. Accordingly, the strap apertures 110 may receive the one or more straps 116 so as to couple an item to the item receiving area 120. It is appreciated that straps 116 allow a user to secure a variety of items by moving the straps 116 closer together or farther apart by threading the straps 116 through strap apertures 110, thus adjusting for the length of the item 118. The straps 116 may comprise hook and loop material 121 (e.g., Velcro®) to secure the straps ends to each other, thereby securing the item 118. Alternatively, the straps 116 may comprise snaps, magnets, hooks, or any other securement mechanism. Further, in one embodiment, the straps 116 may comprise a grip material, such as silicone or rubber. The grip material may be coupled to an inside surface of the straps 116 to secure and prevent movement of the item during a washing or drying cycle. While straps 116 are shown, it will be appreciated that, in some embodiments, elastic webbing may be used. Additionally, other mechanisms to secure the item to the plate may be used, such as clamps, a pocket or receiving portion on the plate 102, or any other attachment mechanism that may be used to secure the item 118 to the item receiving area 120 of plate 102.

Magnets may be embedded in the plate 102 or coupled to its underside so as to allow the plate 102 to securely adhere to the drum during washing or drying. In one embodiment, referring to FIGS. 4-7, the coupling apertures 112 may comprise coupling protrusions 122 therein to receive a bracket 124, which may comprise protrusion slots 126, first attachment apertures 128, and a drum coupler 130 (e.g., a magnet 131, hook and loop, one or more locking pins, etc.). As illustrated, the bracket 124 may be horseshoe shaped, with an enclosed portion 132 and a receiving portion 134. The protrusion slots 126 on the bracket 124 may be positioned over the coupling protrusions 122 in the coupling apertures 112. After the bracket 124 is positioned in the coupling apertures 112 and received by the coupling protrusions 122, the receiving portion 134 may receive the drum coupler 130 and be secured thereto, preventing withdrawal of the bracket 124. While the coupling protrusions 122 are illustrated as two protrusions inside the aperture 112, a single protrusion (e.g., a bar) may extend from one side to the other side of the aperture 112.

The drum coupler 130 may comprise second attachment apertures 136 that receive, for example, screws 138 or any other securement mechanism, such as tongues/grooves, pins, etc. The screws 138 may be positioned through the second attachment apertures 136 and up through the bracket 124 and into the first attachment apertures 128, thereby securing the drum coupler 130 to the receiving portion 134. As shown in FIGS. 8-11, it will be understood that the bracket 124 may be pivotally coupled to the coupling apertures 112 via the coupling protrusions 122, allowing the bracket 124 to pivot so as to engage the drum at any angle. Additionally, the protrusion slots 126 allow the bracket 124 to extend from a bottom 140 of the plate 102 so as to pivot in an area outside of the coupler aperture 112, thereby enhancing contact between the coupler 130 and the drums. It will be understood that one or more brackets 124 and couplers 130 may be used to attach the securing apparatus 100 to washing and drying machines.

In one embodiment, the drum coupler 130 is a magnet 131. Magnet 131 allows the plate 102 to be quickly and easily secured to the drum of a washer or dryer. In one embodiment, as shown in FIGS. 8-11, the magnet 131 is able to pivot, allowing for optimal securing to the drum. By using one or more magnets 131, the plate 102 remains secured, allowing items attached thereto, such as by using straps 116, to remain secured to the drum wall and not be agitated or tumbled in a washer or dryer, solving the problems discussed earlier herein.

In one embodiment, a securing apparatus comprises an electromagnet to couple the plate to the drum of the washer and the dryer. It will be appreciated that the components to control the electromagnet must be sealed or otherwise waterproofed to avoid electrically shorting any components. The electromagnet may be activated and deactivated using a button, switch, or remote.

In one embodiment, a securing apparatus comprises a metal plate and magnets. Accordingly, it will be appreciated that the magnets may be positioned inside of the item (e.g., shoes) so as to couple the item directly to the plate. The plate may also comprise additional magnets coupled to an underside of the plate for contacting the drum of the washer or dryer.

To use the securing apparatus 100, a user may place the item 118 on the item receiving area 120 of plate 102. After the item 118 is placed on the plate 102, one or more straps 116 may be secured over the item 118, depending on the length of the item 118. The securing apparatus 100 may then be placed inside of the drum and coupled to a wall of the drum using the drum coupler 130 (e.g., magnet 131). The bracket 124 of each drum coupler 130 may pivot and be adjusted so as to properly contact the drum, thereby securing the securing apparatus 100 to the drum. It will be appreciated that the item 118 coupled to the drum of a washer or dryer will prevent loud noises as well as any damage to the washing or drying machines and to the item itself. The securing apparatus 100 creates efficient washing of the item and even quicker drying. As an example, when the item (e.g., shoe 118) and the securing apparatus 100 are coupled to a drum of a washing machine, the centrifugal forces aid in removing water from the item 118 faster, thereby decreasing drying times. This is a significant improvement over the prior art, which allowed the items to tumble in a dryer, rather than benefit from centrifugal force.

Accordingly, a method of washing and drying items comprises securing the item to a plate 102 using straps 116, inserting the plate into a washer or dryer drum, and adhering the plate 102 to the drum using one or more drum couplers 130, such as magnets 131. When washing and/or drying is complete, a user may use one or more finger lifts 106, 108 to pull and overcome the magnetism of magnets 131, thereby releasing the plate 102 and removing the plate 102 and the item coupled thereto from the washer/dryer.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. An apparatus for securing items to a drum of a washer or dryer, comprising:

a plate to receive an item, the plate comprising:

strap apertures for receiving one or more straps; and coupling apertures comprising coupling protrusions therein;

one or more brackets coupleable to the coupling apertures, the one or more brackets comprising a drum coupler configured to secure the plate to the drum of the washer or dryer.

2. The apparatus for securing items to the drum of a washer or dryer of claim 1, wherein the plate further comprises a first finger lift.

3. The apparatus for securing items to the drum of a washer or dryer of claim 1, wherein the plate further comprises cutout portions.

4. The apparatus for securing items to the drum of a washer or dryer of claim 1, wherein the plate comprises plastic.

5. The apparatus for securing items to the drum of a washer or dryer of claim 1, wherein the plate is flat.

6. The apparatus for securing items to the drum of a washer or dryer of claim 1, wherein the one or more brackets further comprise protrusion slots to receive the coupling protrusions.

7. The apparatus for securing items to the drum of a washer or dryer of claim 1, wherein the one or more brackets further comprise first attachment apertures.

8. The apparatus for securing items to the drum of a washer or dryer of claim 1, wherein the one or more brackets further comprise an enclosed portion.

9. The apparatus for securing items to the drum of a washer or dryer of claim 8, wherein the one or more brackets further comprise a receiving portion.

10. The apparatus for securing items to the drum of a washer or dryer of claim 1, wherein the drum coupler comprises a magnet.

11. The apparatus for securing items to the drum of a washer or dryer of claim 1, wherein the drum coupler further comprises second attachment apertures.

12. An apparatus for securing items to the drum of a washer or dryer, comprising:

a plate to receive an item, the plate comprising:

one or more finger lifts;

an item receiving area;

strap apertures for receiving one or more straps; and coupling apertures with coupling protrusions therein;

one or more brackets pivotally coupleable to the coupling apertures, the one or more brackets comprising:

protrusion slots to receive the coupling protrusions;

first attachment apertures; and a drum coupler.

13. The apparatus for securing items to the drum of a washer or dryer of claim 12, wherein the drum coupler is a magnet.

14. The apparatus for securing items to the drum of a washer or dryer of claim 12, wherein the one or more brackets further comprise protrusion slots to receive the coupling protrusions.

15. The apparatus for securing items to the drum of a washer or dryer of claim 12, wherein the one of more finger lifts comprise a finger protrusion extending from an edge of the plate.

* * * * *